US005657039A

United States Patent [19]

Mizukata et al.

[11] Patent Number: 5,657,039

[45] Date of Patent: Aug. 12, 1997

[54] DISPLAY DEVICE

[75] Inventors: Katsuya Mizukata, Shijonawate; Takaaki Iemoto, Takaichi-gun, both of Japan

[73] Assignee: Sharp Kabushiki Kaisha, Osaka, Japan

[21] Appl. No.: 335,418

[22] Filed: Nov. 3, 1994

[30] Foreign Application Priority Data

Nov. 4, 1993 [JP] Japan ..... 5-275776

[51] Int. Cl.[6] ..... G09G 3/36

[52] U.S. Cl. ..... 345/95; 345/92

[58] Field of Search ..... 345/92, 95

[56] References Cited

U.S. PATENT DOCUMENTS 5,151,805 9/1992 Takeda et al. ..... 359/57

FOREIGN PATENT DOCUMENTS 64-91185 4/1989 Japan .
336570 10/1989 Japan ..... 345/92
5-210121 8/1993 Japan .
5-61616 9/1993 Japan .
2133602 7/1984 United Kingdom .

OTHER PUBLICATIONS

Fischer, "Flache Fernseh–Bildschirme", NTZ Nachrichtentechnische Zeitschrift, vol. 33, No. 2, Feb. 1980, Berlin, DE, pp. 80–88.

*Primary Examiner*—Richard Hjerpe
*Assistant Examiner*—Vui T. Tran
*Attorney, Agent, or Firm*—Nixon & Vanderhye P.C.

[57] ABSTRACT

On a matrix form display panel which realizes a display device with a high image quality, the return circuits of condensers, connected to picture elements in the last row among picture elements arranged in a matrix form, are connected to a common line independently of the return circuits of the condensers in the other rows, a common electrode driving circuit is provided, and a common electrode driving voltage is applied, whereby the effective values of driving voltages applied to the picture elements in the last row are equalized to the effective values of driving voltages applied to the picture elements in the other rows. Thereby, all the picture elements forming the panel are equal in optical transmissivity, and as a result the displayed image quality is improved. Additionally, since the last scanning line can be used for displaying, the utility factor of display panel is enhanced.

5 Claims, 10 Drawing Sheets

FIG. 3
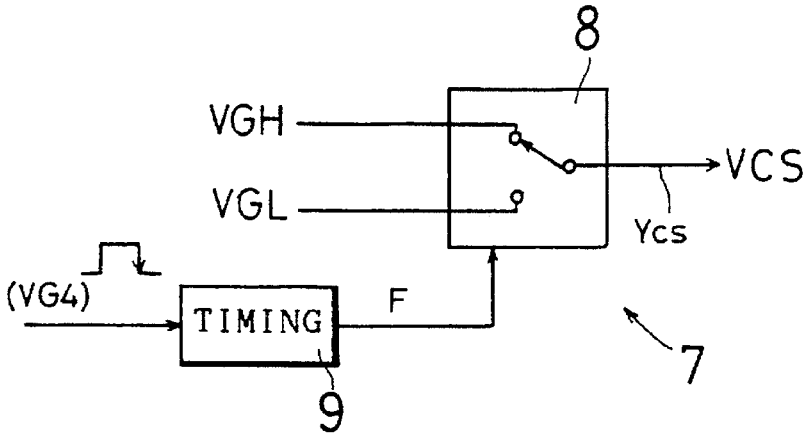
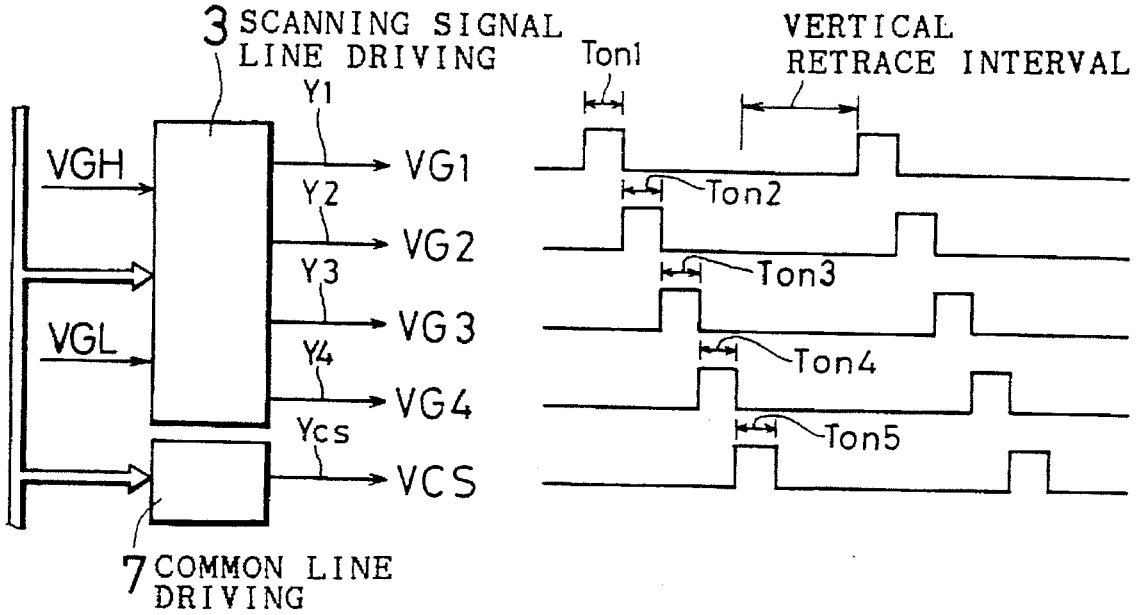
FIG. 4A FIG. 4B

DISPLAY DEVICE

BACKGROUND OF THE INVENTION

1. Field of the Invention

The present invention relates to a display device using a liquid crystal display panel of an active matrix type or the like, in particular to a display device using a display panel in which capacitance elements are individually connected to a plurality of picture element electrodes.

2. Description of the Related Art

Single matrix type display panels, for example, in which a pair of light transmitting substrates sandwiching a liquid crystal layer therebetween are opposed to each other, a plurality of scanning electrodes are arranged on one of the pair of substrates and a plurality of display electrodes are arranged on the other of the pair of substrates so that they intersect each other, are suitable for enlarging the panels in size because of their simple constitution, so that they have been widely used. However, since such panels have a few problems regarding response and crosstalk, active matrix type display panels in which switching elements are individually connected to picture elements are used for image display means of apparatuses such as TV receivers and personal computers, in which images are moved fast and a high resolution is required.

FIGS. 10, 11 are block diagrams showing constitutions of display devices of the prior art. For the purpose of simplification, in both the figures, an active matrix type display panel 52 is presented in a 4×4 matrix form, namely 16 picture elements. The display devices, 51A, 51B shown in FIGS. 10, 11, respectively, have a similar constitution to each other, and therefore the parts corresponding to each other are represented by the same reference numerals. More specifically, the display devices 51A, 51B are constituted identically, excepting that the return circuits of capacitance elements CS are connected to a counter electrode driving circuit 56 in the prior art as shown in FIG. 10, and in the prior art as shown in FIG. 11 they are connected to a power supplying circuit 54L for scanning. Accordingly the following description will be mentioned in respect of the display device 51A shown in FIG. 10.

In the active matrix type display panel 52 (hereinafter described as "display panel"), a plurality of signal lines Y51–Y54 for scanning (when generically described, represented by a reference numeral Y) and a plurality of signal lines X51–X54 for displaying (when generically described, represented by a reference numeral X) are arranged to intersect each other on one of the pair of substrates confronting each other and sandwiching a liquid crystal layer therebetween, and in the portions where the signal lines for scanning (hereinafter described as "scanning signal lines") and the signal lines for displaying (hereinafter described as "display signal lines") intersect each other are arranged picture element electrodes p51–p66. On the other of the pair of substrates are arranged counter electrodes q51–q66 so that each of them is opposed to each of the picture element electrodes. In such a manner, 16 picture elements P51–P66 arranged in a 4×4 matrix form are formed.

When the picture elements, picture element electrodes, and counter electrodes are generically described, they are represented by the reference numerals P, p, and q, respectively. Further, the scanning signal lines Y are also called "line in the first row, the second row, . . . " in the arrangement direction and on the other hand, the display signal lines X are also called "line in the first column, the second column, . . . " in the arrangement direction. Additionally, although practically the counter electrodes are formed as one piece of electrode on the other substrate in all, each picture element P is equivalently represented as a condenser for the purpose of simplifying the description, and the counter electrodes q51–q66 are represented to be connected to a counter electrode driving line Lq. A counter electrode driving voltage VQ outputted from the counter electrode driving circuit 56 is applied to the counter electrodes q51–q66 via a counter electrode driving line Lq.

On the one substrate, switching elements SW51–SW66 (when generically described, represented by a reference numeral SW) realized by thin film transistors (TFTs) are formed together with capacitance elements CS51–CS66 (when generically described, represented by a reference numeral CS), in a manner such that the switching elements SW51–SW66 correspond to the picture elements P51–P66 in a one-to-one correspondence manner. The source of the switching element SW is connected to the display signal line X and the drain of the switching element SW is connected to the picture element electrode p, individually. The switching element SW is in ON-state when scanning signals VG51–VG54 of each line applied to the gate are at high levels, and in OFF-state when the scanning signals VG51–VG54 are at low levels. A scanning signal lines driving circuit 53 is so constituted that a shift register which shifts a pulse every horizontal scanning period, and a level shifter circuit which shifts to high- and low-level scanning power supply voltages VGH, VGL outputted from scanning power supply circuits 54H, 54L in accordance with the pulses of the shift register are built-in, and the scanning signals to be changed into a low and a high level signal within one horizontal scanning period are derived in the scanning signal lines Y51–Y54.

The capacitance elements CS51–CS66 (hereinafter described as "condenser") are formed on the one substrate in parallel with the formation of the switching elements SW, in order to control the dispersion of the capacity of each picture element P as a capacitive element, and minimize the voltage drop. One electrodes of each of condensers CS is individually connected to the picture element electrodes p, and the other electrodes (hereinafter described as "return circuits"), as shown in Japanese Unexamined Patent Publication JPA 64-91185 (1989), are connected to the scanning signal line Y in the next row on the substrate, adjacent to the row of the picture elements to whose electrodes p the one electrodes of the condensers are connected, excepting that the return circuits of condensers CS63–CS66 in the fourth row are connected to the counter electrode driving line Lq in common because of the lack of scanning signal line in the next row.

Display signals VS51–VS54 corresponding to image data are individually applied to the display signal lines X51–X54 via a display signal lines driving circuit. For example, when a high-level scanning signal VG51(H) is applied to the scanning signal line Y51, the switching elements SW51–SW54 in the first row are turned on, and the display signals VS51–VS54 are applied to the picture elements P51–P54 in the first row via the display signal lines X51–X54. The polarity of the display signal VS is inverted every horizontal scanning period by a so-called alternating-current-like inversion driving method, in order to prevent polarization of the picture elements and flicker in displaying, and besides the display signal VS has a waveform such that the inversion order is alternated every vertical scanning period.

FIGS. 12A–12I are waveform diagrams of each part of the display device 51A. In FIGS. 12A–12I, the parts corresponding to those in FIG. 10 are represented by the same reference numerals as those in FIG. 10. In FIGS. 12A–12I, the transverse axis indicates times and the vertical axis voltage or signal levels. A value of 63.5 μS for a horizontal scanning period 1H and a value of 262.5H (H indicates one horizontal scanning period) for one vertical scanning period 1B are based on a NTSC mode which is a TV standard mode. A vertical scanning period 1B for one field begins at a time t1. Time periods T1–T4 indicate the scanning periods for the scanning lines Y51–Y54. In the waveform diagrams, the period after a finish time t8 of an ON period $T_{on4}$ in the fourth row is considered as a vertical retrace interval on the basis of the 4×4 matrix.

FIGS. 12A–12D are waveform diagrams of scanning signals VG51–VG54 applied to the scanning signal lines Y51–Y54. The high-level periods of the scanning signals VG51–VG54 mean ON periods $T_{on1}$–$T_{on4}$ of the switching elements SW in each row, and the levels are equal to the power supply voltage VGH of high level for scanning outputted from a power supply circuit 54H for scanning (hereinafter described as "scanning power supply circuit"). The reason why the waveforms pulsates every 1H has a relationship with the below-mentioned power supply voltage VGL for scanning (hereinafter described as "scanning power supply voltage").

FIG. 12E is the waveform diagram of the low-level scanning power supply voltage VGL outputted from the scanning power supply circuit 54L. The scanning power supply voltage VGL pulsates every 1H. This is because alternating-current-like inversion driving is caused by the connection of the return circuit of the condenser CS. The switching elements SW are set to be at low level which is enough to maintain the switching elements in OFF state.

FIG. 12F is the waveform diagram of the counter electrode driving voltage VQ derived from the counter electrode driving circuit 56. Since the counter electrode driving voltage VQ is applied to the counter electrode q of the picture element P, the polarity is inverted every horizontal scanning period 1H due to alternating-current-like like inversion driving, and the voltage is synchronized with the scanning power supply voltage VGL. Consequently, like the display device 51B shown in FIG. 11, the return circuits of the condensers CS63–CS66 in the fourth row may be connected to the scanning power supply circuit 54L in common without causing problems and therefore the return circuits are connected to either of the counter electrode driving line or the scanning power supply circuit 54L, depending on the circuit pattern of the substrate.

FIG. 12G shows the waveform of the display signal VS. The display signal VS is a inverse signal, the polarity of which is inverted every horizontal scanning period due to alternating-current-like inversion drive, and although the display signals VS51–VS54 for each column are applied to the display signal lines individually via the display signal lines driving circuit 55, the display signals VS are indicated by a waveform inverted at the same level.

FIGS. 12H, 12I show a drive voltage VD55 applied to the picture element P55 in the second row and a driving voltage VD63 applied to the picture element P63 in the fourth row, respectively. Since the switching element SW55 is turned on/off via the scanning signal 52, the driving voltage VD55 applied to the picture element P55 in the second row changes as shown in FIG. 12H. Additionally, since the switching element SW63 is turned on/off via the display signal VG54, the driving voltage VD63 applied to the picture element P63 in the fourth row changes as shown in FIG. 12I. Such changes apply also to the other picture elements (not shown).

Although the waveforms of the driving voltages VD55, VD63 synchronize with the changes due to alternating-current-like inversion drive and change with a constant amplitude in periods excluding periods $T_{on2}$, $T_{on4}$, on the driving voltage VD55, the level of a voltage VGC is superposed on the driving voltage VD55 in the scanning period in the next third row, as shown in FIG. 12H. This is because the return circuit of the condenser CS55 connected to the picture element P55 is connected to the scanning signal line Y53 in the next third row. Consequently, in accordance to the capacity ratio of the capacitance Cp of the picture element P to the capacitance Cs of the condenser CS, the partialized voltage VGC as shown in the following equation (1) is superposed on the driving voltage VD52 in a scanning period T3 when the scanning signal VG53 is at a high level.

$$VGC=Cs(VGH-VGL)/(Cs+Cp) \quad (1)$$

Although a floating capacitance exists between the gate and drain of the switching element due to constitutional reasons of the TFT, the capacitance is small in comparison with the Cp, Cs, and accordingly neglected herein.

The voltage VGC is also superposed on driving voltages which are applied to picture elements (not shown) in the first row and the third row, at different positions. On the driving voltages of the picture elements P63–P66 in the fourth row, is not superposed the voltage VGC like the waveform of the driving voltage VD83 as representatively shown in FIG. 12I. This is because the return circuits of the condensers CS63–CS66 in the fourth row are connected to the counter electrode driving line Lq or the scanning power supply circuit 54L shown in FIG. 11, unlike those in the other rows. For this reason, the waveform of the driving voltage VD63 applied to the picture element P63 in the last, namely fourth row is different from those of the driving voltages applied to the picture elements in the other rows, and the effective value of the driving voltage in the last row applied during a scanning period is lower than that in the other rows.

As described above, in display devices of the prior art, the effective values of the driving voltages in the last fourth row (e.g., VD63) are lower than those of the driving voltages in the first through third rows (e.g., VD51).

The optical transmissivity of the picture element P, namely the liquid crystal layer, changes depending on the effective value of a voltage applied. Consequently, even when the equivalent display voltage VS is applied, a driving voltage applied to the picture elements forming the last row has a lower effective value than in the other rows, and, for example, in a normally white type display panel (during no voltage application: white color image; during voltage application: black color image), the black color image in the last row becomes whiter than that in the other rows and the display quality is lowered. Such disadvantage can be eliminated when also the return circuits of the condensers in the other rows are connected to the scanning power supply voltage VGL or the counter electrode VQ like the condensers in the last row. Such connection, however, makes the wiring of the liquid crystal display panel complex and accordingly causes other problems such as reduction of area available for picture elements.

For the above reasons, in conventional liquid crystal display panels, countermeasures such that the last row of a display panel is masked, for example, 479 rows are available in a display panel with 480 rows, have been taken.

In the VGA standard employed in display panels for personal computers, however, the number of rows is defined as 480, and therefore it is problematic that the data displayed in the display panel is not sufficient when the picture elements in the last row are masked.

SUMMARY OF THE INVENTION

The invention is presented in view of the aforementioned problems and an object of the invention is to provide a display device with a display panel having an improved display quality in which picture elements in the first and last rows have also the same gradation as that of the other rows.

The invention provides a display device comprising:

a. a display panel including:

a plurality of picture element electrodes arranged in a matrix form, a counter electrode formed to confront the picture element electrodes, a plurality of switching elements individually connected to the plurality of picture element electrodes, a plurality of scanning signal lines to which scanning signals for connecting/disconnecting the switching elements individually are applied, a plurality of display signal lines which are arranged to intersect the scanning signal lines and apply display signals via the switching elements to the plurality of picture element electrodes, a counter electrode driving line connected to the counter electrode, and a plurality of capacitance each having one terminal individually connected to a respective one of the plurality of picture element electrodes and other terminals which are connected to the scanning signal lines selected prior to or after one horizontal scanning period;

b. a scanning signal lines driving circuit which sequentially scans the scanning signal lines every horizontal scanning period and applies the scanning signals;

c. a display signal lines driving circuit which applies display signals to the display signal lines; and d. a counter electrode driving circuit which applies a counter electrode driving voltage to the counter electrode driving line, wherein a common line to which the other terminals of the capacitance elements connected to picture element electrodes provided in connection with only the scanning signal lines selected by a first or last scanning of the sequential line scannings are connected, is provided in the display panel, and the display device further comprises a common line driving circuit which applies to the common line a driving voltage for changing the voltage levels of the other terminals of the respective capacitance elements connected to the picture element electrode provided in connection with the scanning signal lines selected by the first or last scanning of the sequential line scannings.

The invention is characterized in that the common line driving circuit applies the driving voltage to the common line in a vertical retrace interval.

The invention provides a display device comprising:

a. a display panel including:

a plurality of picture element electrodes arranged in a matrix form, a counter electrode formed to confront the picture element electrodes, a plurality of switching elements individually connected to the plurality of picture element electrodes, a plurality of scanning signal lines to which scanning signals for connecting/disconnecting the switching elements individually are applied, a plurality of display signal lines which are arranged to intersect the scanning signal lines and apply display signals via the switching elements to the plurality of picture element electrodes, a counter electrode driving line connected to the counter electrode, and a plurality of capacitance elements each having one terminal individually connected to a respective one of the plurality of picture element electrodes and other terminals which are connected to the scanning signal lines selected in a following horizontal scanning period;

b. a scanning signal lines driving circuit which sequentially scans the scanning signal lines every horizontal scanning period and applies the scanning signals;

c. a display signal lines driving circuit which applies display signals to the display signal lines; and d. a counter electrode driving circuit which applies a counter electrode driving voltage to the counter electrode driving line, wherein a common line to which the other terminals of the capacitance elements connected to picture element electrodes provided in connection with only the scanning signal lines selected by the last scanning of the sequential line scannings are connected is provided in the display panel, and scanning signals in the first scanning signal line are applied as driving voltages for changing the voltage levels of the other terminals of the respective capacitance elements connected to the picture element electrodes provided in connection with the scanning signal lines selected by the last scanning of the sequential line scannings.

The invention provides a display device comprising:

a. a display panel including:

a plurality of picture element electrodes arranged in a matrix form, a counter electrode formed to confront the picture element electrodes, a plurality of switching elements individually connected to the plurality of picture element electrodes, a plurality of scanning signal lines to which scanning signals for connecting/disconnecting the switching elements individually are applied, a plurality of display signal lines which are arranged to intersect the scanning signal lines and apply display signals via the switching elements to the plurality of picture element electrodes, a counter electrode driving line connected to the counter electrode, and a plurality of capacitance elements each having one terminal individually connected to the plurality of picture element electrodes and other terminals which are connected to the scanning signal lines selected in a following horizontal scanning period;

b. a scanning signal lines driving circuit which sequentially scans the scanning signal lines every horizontal scanning period and applies the scanning signals;

c. a display signal lines driving circuit which applies display signals to the display signal lines; and d. a counter electrode driving circuit which applies a counter electrode driving voltage to the counter electrode driving line, wherein a common line to which the other terminals of the capacitance elements connected to picture element electrodes provided in connection with only the scanning signal lines selected by a scanning of the sequential line scannings are connected is provided in the display panel, and scanning signals in a scanning signal line of one or more lines before the last scanning line are applied as driving voltages for changing the voltage levels of the other terminals of the respective capacitance elements connected to the picture element electrodes provided in connection with the scanning signal lines selected by the last scanning of the sequential line scannings.

According to the invention, the display device is provided with a common line to which one terminal of a capacitance element selected by the first or last scanning among the capacitance elements, which are arranged to correspond to the plurality of picture element electrodes arranged in a matrix form and the other terminals of which are individually connected to the picture element electrodes, is connected, and a common line driving circuit which applies driving voltages for changing voltage levels of both terminals of each capacitance element is connected to the common line.

Thereby, to a picture element electrode selected by the first or last scanning among the picture element electrodes arranged in a matrix form on a display panel is applied a driving voltage of the same level as the other picture element electrodes and the effective values of the driving voltages applied to the picture elements forming the display panel are identical over the entire scanning signal lines. Consequently the optical transmissivity of the picture elements arranged in the scanning signal line in the first or last row is improved and as a result, the picture elements are given the same gradation as that of the other picture elements.

As aforementioned, in the display device according to the invention, one terminal of a capacitance element selected by the first or last scanning of sequential line scannings among the capacitance elements individually connected to the plurality of picture element electrodes arranged in a matrix form on the display panel is connected to the common line provided on the display panel, and to the common line are applied driving voltages for changing the voltage levels of both ends of the selected capacitance element, via the common line driving circuit.

Thereby, the effective values of the driving voltages applied to the picture elements forming the display panel are identical over the entire scanning lines. Consequently the optical transmissivity of the picture elements arranged in the scanning signal line in the first or last row is improved and as a result the picture elements are given the same gradation as that of the other picture elements.

Additionally, a display device in which the first and last scanning signal lines are also used for displaying, which could not be achieved in conventional display apparatuses, can be realized.

Additionally, according to one aspect of the invention, the scanning signals in the first scanning signal line or one or more rows before the last scanning line of one frame are allowed to apply as driving voltages for the capacitance elements corresponding to the scanning signal line selected by the last scanning, whereby the aforementioned object of the invention can be achieved and the construction also can be simplified by eliminating the common line driving circuit.

BRIEF DESCRIPTION OF THE DRAWINGS

Other and further objects, features, and advantages of the invention will be more explicit from the following detailed description taken with reference to the drawings wherein:

FIG. 3 is a block diagram showing a constitution of a common line driving circuit applied to the display device shown in FIG. 1;

FIGS. 4A, 4B are a block diagram and a time chart, respectively, showing another constitution of the common line driving circuit applied to the display device shown in FIG. 1;

DETAILED DESCRIPTION OF THE PREFERRED EMBODIMENTS

Figure 1:
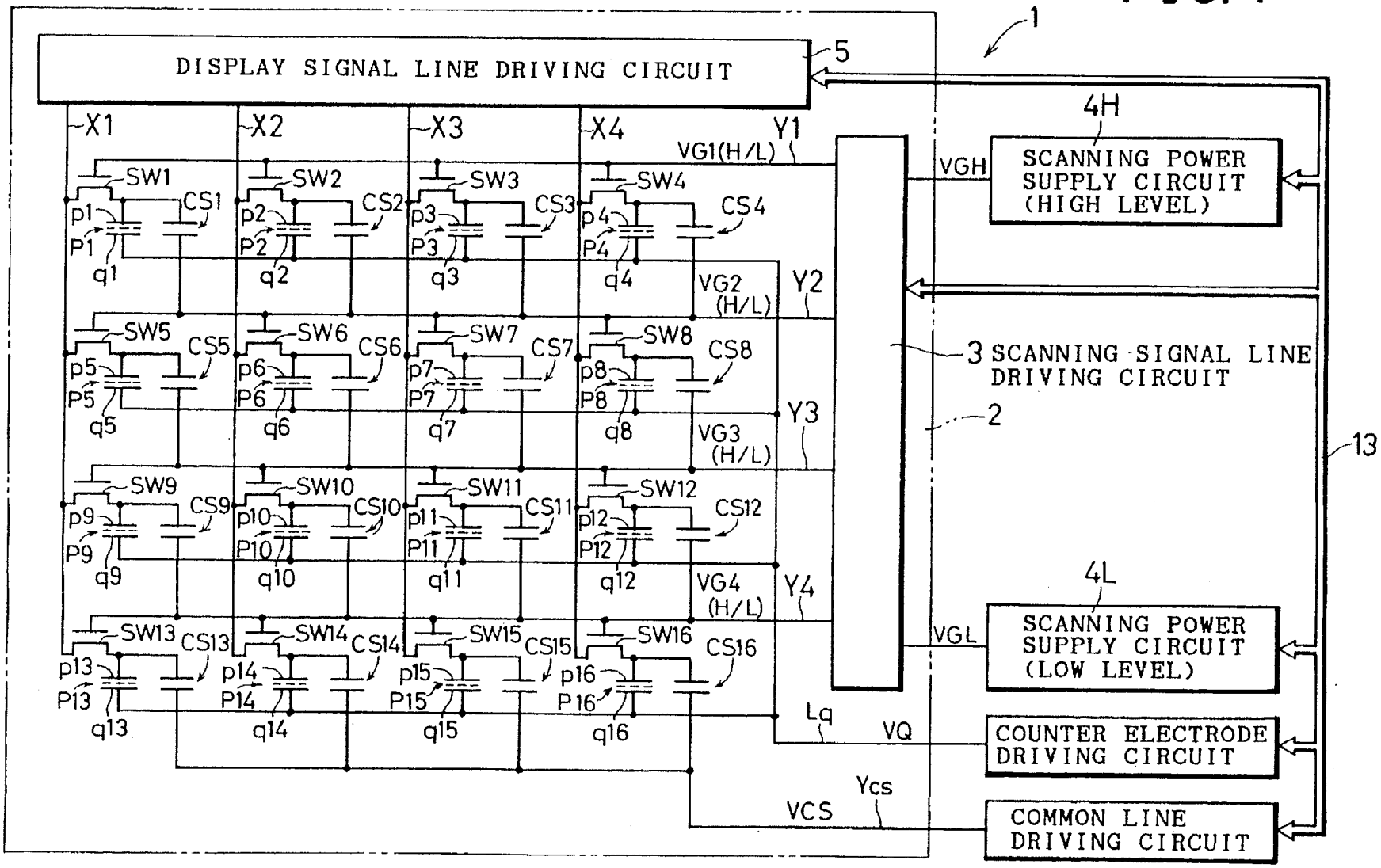
FIG. 1 is a block diagram showing a constitution of an embodiment of a display device of the invention.

Now referring to the drawings, preferred embodiments of the invention are described below.

FIG. 1 is a block diagram showing a constitution of an embodiment of a display device 1 of the invention. The display panel 2 of FIG. 1 is represented by a display panel with 16 picture elements (4 row×4 column) for the purpose of simplifying the description. The display panel 2 is realized by liquid crystal elements. In the display panel, a pair of light transmitting substrates sandwiching a liquid crystal layer therebetween are opposed to each other, plural scanning signal lines Y1–Y4 (when generically described, represented by a reference numeral Y) and plural display signal lines X1–X4 (when generically described, represented by a reference numeral X) are arranged on one of the pair of substrates to be crossed each other and picture element electrodes p1–p16 are arranged in the portions where the scanning signal lines and the display signal lines intersect each other. On the other substrate of the pair of substrates are arranged counter electrodes q1–q16 so as to be opposed to the picture element electrodes. In such a manner, 16 picture elements arranged in a 4×4 matrix form are formed.

When the picture elements, picture element electrodes, and counter electrodes are generically described, they are represented by the reference numerals P, p, and q, respectively. Further, the scanning signal lines Y are also called "line in the first row, the second row, . . . " in the arrangement direction and on the other hand, the display signal lines X are called "line in the first column, the second column, . . . " in the arrangement direction. Additionally, although the counter electrodes are formed on the other substrate as one piece of electrode in practice, each picture element P is equivalently represented as a condenser for the purpose of simplifying the description, and the counter electrodes q1–q16 are represented to be connected to a counter electrode driving line Lq. A counter electrode driving voltage VQ outputted from the counter electrode driving circuit 6 is applied to the counter electrodes q1–q16 via a counter electrode driving line Lq.

On one substrate of the pair of substrates of the display panel 2, switching elements SW1–SW16 realized by TFTs (thin film transistors) are formed together with capacitance elements CS1–CS16, in a one-to-one correspondence manner such that one capacitance element corresponds to one picture element. The sources of the switching elements SW1–SW16 are connected to the display signal lines X and the drains of the switching elements SW1–SW16 are connected to the picture element electrodes p, individually. The switching elements SW1–SW16 are in ON-state when scanning signals VG1–VG4 applied to the gates via the scanning signal lines Y1–Y4 are at high levels, and they are in OFF-state when the scanning signals VG1–VG4 are at low levels. The high- and low-level scanning signals VG1(H/L) –VG4(H/L) are fed by the selection of scanning power supply voltages VGH, VGL, which are respectively outputted from scanning power supply circuits 4H, 4L, by the scanning signal lines driving circuit 3.

The capacitance elements CS1–CS16 (hereinafter described as "condenser" and generically represented by a reference numeral CS) are formed on the one substrate in parallel with the formation of the switching elements SW, in order to control the dispersion of each capacitance for the picture elements P as capacitive elements, and minimize the voltage drop. One electrode of each the condensers CS is individually connected to respective picture element electrodes p, and the other electrodes (hereinafter described as "return circuits") are connected to the scanning signal line Y in the next row on the substrate, adjacent to the row of the picture elements to whose electrode p the one electrodes of the condensers are connected. However, the scanning signal line in the next row to which the return circuits of condensers CS13–CS16 in the fourth row are to be connected does not exist. Thus, the scanning signal line in the next row where the return circuits of the condensers CS13–CS16 in the last fourth row are to be connected, is not found.

It is remarkable in the invention that on the substrate is provided a common line Ycs, and a common line driving circuit 7 for applying a common line driving voltage VCS to the common line Ycs in a vertical retrace interval is provided. The return circuits of the condensers CS13–CS16 arranged in the last row (fourth row in the embodiment) are connected to the common line Ycs, via which the return circuits are connected to the common line driving circuit 7. The common line driving voltage VCS is set to the same phase and level as those of the scanning signals VG1–VG4 applied to the scanning signal lines Y1–Y4. Since the same level voltage as the voltage of the condensers CS1–CS12 in the other rows, thereby, is also applied to the condensers CS13–CS16 in the last row, such that the effective value of the driving voltage applied to the picture elements P13–P16 in the last row is reduced and a disadvantage is eliminated.

Although, in the embodiment, the return circuits condensers CS13–CS16 in the last row are connected to the common line Ycs, return circuits connected to the common line Ycs may be those of the condensers CS1–CS4 in the first row, by the reason of the substrate circuit pattern. In such case, the return circuits of the condensers CS5–CS8 in the second row and those of the condensers CS9–CS12 in the third row are connected to the scanning signal lines Y1 and Y2, respectively, and those of the condensers CS13–CS16 in the fourth row are connected to the scanning signal line Y3.

The counter electrodes q1–q16 of the picture elements p are commonly connected to a counter electrode driving line Lq, and the counter electrode driving voltage VQ outputted from the counter electrode driving circuit 6 is applied. The counter electrode driving voltage VQ is the same as the common line driving voltage VCS in phase.

From an image signal line (not shown) are individually applied display signals VS corresponding to image data, to the display signal lines X1–X4 through a display signal lines driving circuit 5. For example, in a horizontal scanning period T1, the switching elements SW1–SW4 in the first row are turned on, and the display signals VS1–VS4 corresponding to image data are applied to the picture elements P1–P4 in the first row via the display signal lines X1–X4. As shown in FIG. 2G, the display signals VS, in order to prevent polarization of capacitive picture elements P and flicker in displaying, are applied by the alternate-current-like inversion driving method. In the method, the inversion order is changed every vertical scanning period 1H.

The scanning power supply circuits 4H, 4L, counter electrode driving circuit 6, common line driving circuit 7 and display signal lines driving circuit 5 are connected to a line 13 to operate synchronously.

FIGS. 2A–2I are waveform diagrams showing a performance waveform of each part of the display device 1 shown in FIG. 1. The parts corresponding to those in FIG. 1 are represented by the same reference numerals as in FIG. 1. The value of the horizontal scanning period 1H of 63.5 μS and the value of the vertical scanning period 1B of 262.5H (H means one horizontal scanning cycle are based on the NTSC mode of a TV standard mode.

One field of vertical scanning period 1B starts at a time t1. Times t1–t4 represents the horizontal scanning periods of the first through the fourth row, respectively.

FIG. 2A–2D show waveforms of the scanning signals VG1–VG4 applied to the scanning signal lines Y1–Y4. The high-level periods of the scanning signals VG1–VG4 are the ON periods $T_{on1}$–$T_{on4}$ of the switching elements in each row and set to about 50 μS which is obtained by deducting a horizontal retrace interval Th from the horizontal scanning period 1H. The other periods are in OFF-state. The waveform pulsation observed every H is in relation to the alternating-current-like inversion driving of the scanning power supply voltage VGL of a low level.

FIG. 2E is the waveform of the common line driving voltage VCS outputted from the common line driving circuit 7. Although the waveform of the common line driving voltage VCS is the same as that of the scanning signals VG1–VG4, the level of the common line driving voltage VCS is set to be at a high level in a ON period $T_{on5}$ within a horizontal scanning period T5 at times t9, t10 after the scanning period T4. Consequently, the phase of the common line driving voltage VCS is lagged by the horizontal scanning period 1H as compared to the scanning signal VG4 in the fourth row, and the common line driving voltage VCS behaves as if it was a scanning signal in the fifth row and corrects the level of the voltages applied to both terminals of each of the condensers CS13–CS16 in the last or fourth row.

FIG. 2F is a waveform diagram of a counter electrode driving voltage VQ derived from a counter electrode driving circuit 6. Since the counter electrode driving voltage VQ is applied to the counter electrode q of the picture element P, the counter electrode driving voltage VQ has a waveform inverted by the alternating-current-like inversion, whose level is reversed every horizontal scanning period, and is a signal synchronized with the scanning signal VG1–VG4 applied to the condenser CS.

FIG. 2G is a waveform diagram of a display signal VS. The display signal VS is a signal, the polarity of which is inverted every horizontal scanning period through alternating-current-like inversion driving, and although the level of the display signal is set on the basis of image data and the display signal is applied to each of the display signal lines X1–X4. Herein the display signal is shown in a waveform where high and low levels are inverted in the same absolute level.

The picture element P5 in the second row and the first column and the picture element P13 in the fourth row and the first column are selected to show the waveforms of the driving voltages VD5, VD13 applied to the respective picture elements in FIG. 2H, 2I, respectively. When the display signals VS are outputted in the display signal line X1, the driving voltage VD5 applied to the picture element P5 in the second row changes as shown in FIG. 2H. On the other hand, the driving voltage VD13 applied to the picture element P13 in the fourth row changes as shown in FIG. 2I. Although the driving voltages VD5, VD13 change synchronously with the counter electrode driving voltage VD5 and the low-level scanning signals VG2(L), VG4(L) in the OFF period of the switching element SW, a voltage VGC is superposed on the driving voltage VD5 in the next scanning period T3. This is because the return circuit of the condenser CS5 in the second row is connected to the scanning signal line Y3 in the next third row. For this reason, the partialized voltage VGC shown in the aforementioned equation (1) is superposed on a driving voltage VD2 in accordance with the capacity ratio of the capacitance Cp of the picture element P to the capacitance Cs of the condenser CS in the scanning period T3 when the scanning signal VG3 is at a high level.

$$VGC=Cs(VGH-VGL)/(Cs+Cp) \quad (1)$$

The voltage VGC is also superposed on driving voltages VD1, VD3 in the first and third rows, respectively, in the following scanning periods thereof. Additionally, since a common line driving voltage VCS equivalent to the scanning signals VG1–VG4 is applied to the return circuit of the condenser CS in the last fourth row, the same-level voltage VGC is superposed thereon. The voltage VGC superposed on the driving voltage in the fourth row is obtained by substituting Cs (VCS(H)–VCS(L)), wherein VCS(H) is a high-level common line driving voltage and equal to VGH and VCS(L) is a low-level common line driving voltage and equal to VGL, for the numerator portion of the right side of the equation.

FIG. 3 is a block diagram showing a constitution of a common line driving circuit applied to the display device shown in FIG. 1. High- and low-level scanning power supply voltages VGH, VGL derived from scanning power supply circuits 4H, 4L as shown in FIG. 1 are inputted into an analog switch 8, which is driven by an output F outputted from a timing circuit 9 realized by a counter or the like, and the common line driving voltage Vcs in $T_{on5}$=50 μS is outputted into the common line Ycs. If, for example, falling in the scanning period T4 of the scanning signal VG4 in the fourth row is used for presetting the timing, the common line driving voltage VCS corresponding to the scanning signals in the fifth row can be outputted. A constitution wherein horizontal scanning signals, shift registers etc. are used may be also employed.

FIG. 4 shows another embodiment where a common line driving voltage VCS is obtained. In the embodiment, the number of output terminals of a scanning signal line driving circuit 3 as shown in FIG. 4A amounts to 5 by increasing by one, and after high-level scanning signals VG1–VG4 are in order outputted into scanning lines Y1–Y4 by sequential line scanning, a fifth output VCS is outputted into the common line Ycs in the same time $T_{on}$ (in the embodiment 50 μS).

In the aforementioned embodiment, a margin for the driving voltage VD applied to the picture elements P is obtained by applying between the picture element electrode p and counter electrode q of the picture element P the display signal VS and the counter electrode driving voltage VQ which are in a phase inverse to each other. Additionally the same effect can be obtained also by increasing the level of the display signal VS and maintaining the counter electrode driving voltage VQ applied to the counter electrode driving line Lq constant.

Figure 5A:
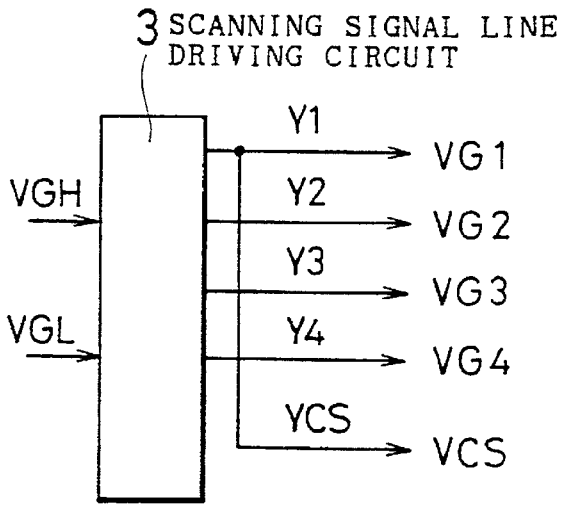
FIGS. 5A, 5B are a block diagram and a time chart, respectively, showing still other constitution for obtaining a common line driving voltage VCS in another embodiment of the invention, corresponding to FIGS. 4A, 4B.
Figure 5B:
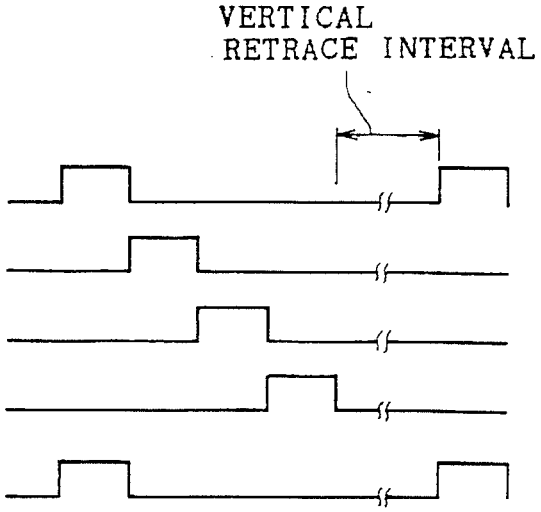

FIGS. 5A, 5B are a block diagram and a time chart, respectively, showing still another constitution for obtaining the common line driving voltage VCS in another embodiment of the invention, corresponding to FIG. 4A, 4B. In the embodiment, the scanning signal VG1 from the scanning signal line Y1 in the first row is used as a common line driving voltage VCS of the return circuits of the condensers CS13–CS16 in the fourth row.

Figure 6A:
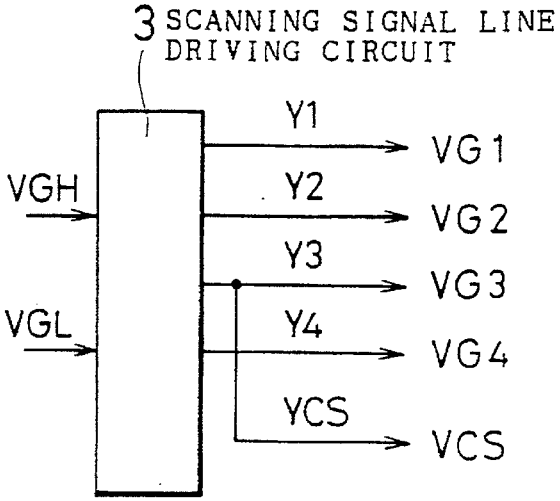
FIGS. 6A, 6B are a block diagram and a time chart, respectively, showing yet another constitution for obtaining a common line driving voltage VCS in still another embodiment of the invention.
Figure 6B:
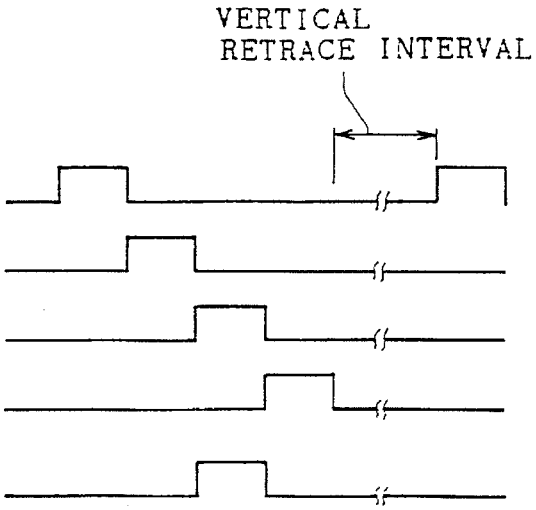

FIGS. 6A, 6B are a block diagram and a time chart, respectively, showing yet another constitution for obtaining the common line driving voltage VCS in still another embodiment of the invention. In the embodiment, the scanning signal VG3 from a scanning signal line Y3 in the row of one or more rows before is supplied as a voltage of the return circuits of the condensers CS13–CS16 in the fourth row.

The embodiments of FIGS. 5, 6 are similar to the embodiments of FIGS. 1, 4. However, in the embodiments of FIGS. 5, 6, the common line driving circuit 7 is omitted and the line Ycs is connected as shown in FIGS. 5, 6. The other constitutions of FIGS. 5, 6 are the same as that of FIGS. 1, 4.

Figure 2:
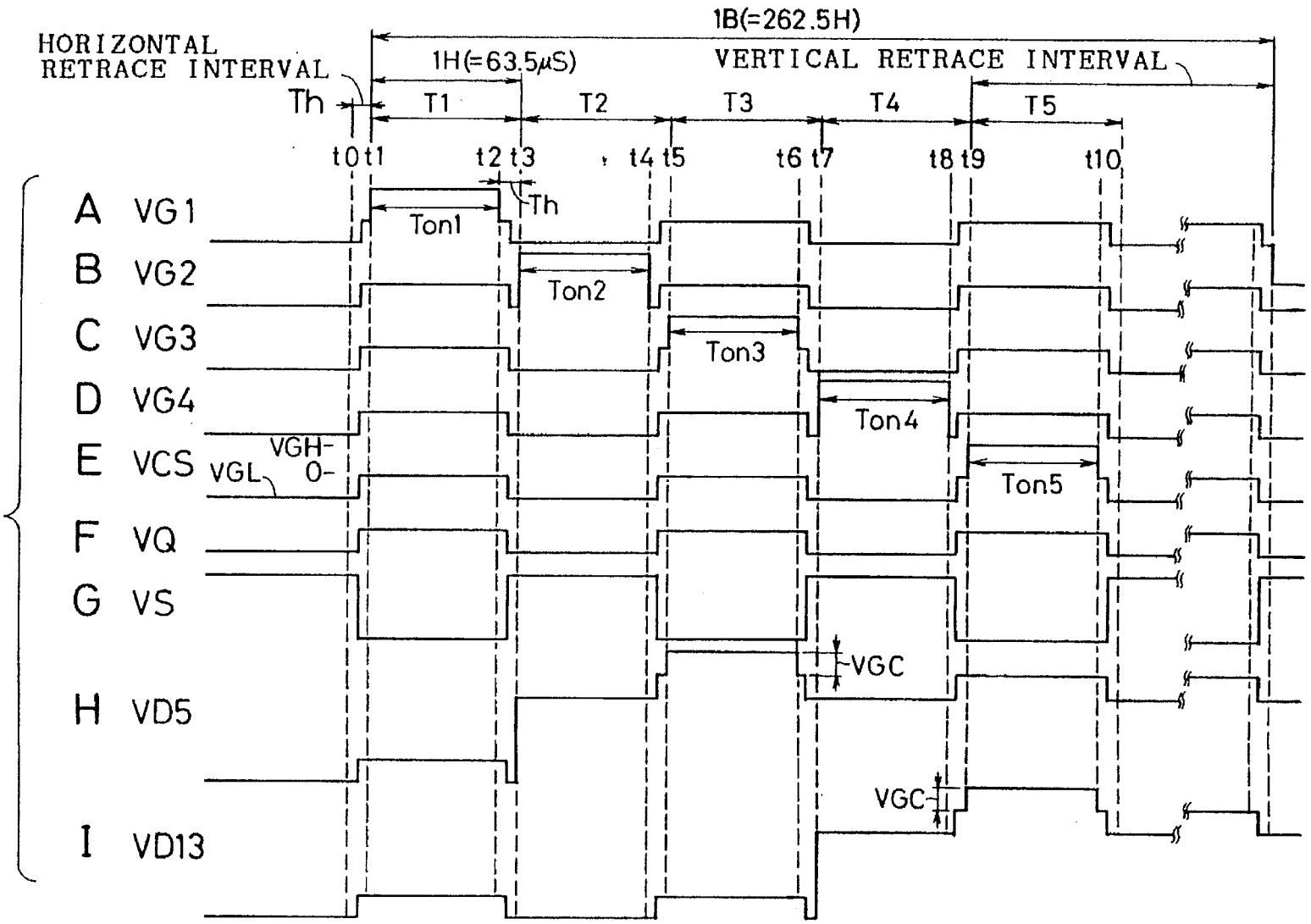
FIGS. 2A–2I are waveform diagrams showing a performance waveform of each part of the display device shown in FIG. 1.
Figure 7:
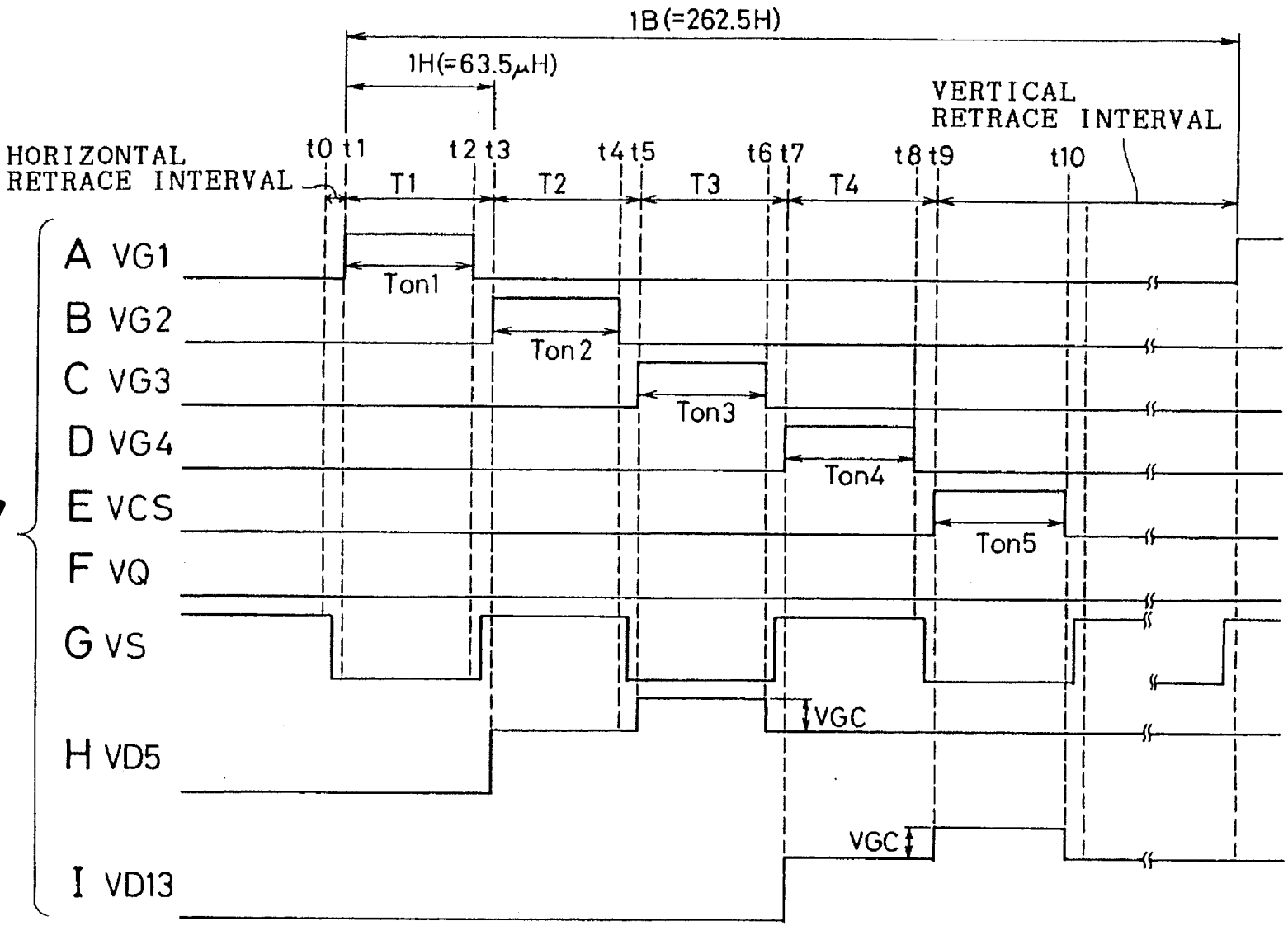
FIGS. 7A–7I are waveform diagrams showing a performance waveform of each part of another embodiment of the invention.

FIGS. 7A–7I show performance waveforms in the case where the counter electrode driving voltage VQ is of a constant direct current level. FIG. 7 is similar to the above-presented FIG. 2 and the parts corresponding to those in FIG. 2 are represented by the same reference numerals as in FIG. 2. In the embodiment, the level of the counter electrode driving voltage VQ is maintained constant (e.g., 3 V) as shown in FIG. 7F. Since the level of the counter electrode driving voltage VQ is not changed, the scanning signals VG1–VG4 as shown in FIGS. 7A–7D and the common line driving voltage VCS as shown in FIG. 7E are outputted as high-level scanning signals VG1(H)–VG4(H) and a high-level common line driving voltage VCS(H) in the scanning periods T1–T4, T5, respectively.

FIG. 7G shows the waveform of a display signal. The waveform is such that, like the waveform shown in FIG. 2G, the polarity of the display signal VS is inverted every horizontal scanning period and the inversion order is alternated every vertical scanning period.

FIG. 7H shows the waveform of the driving voltage VD5 applied to the picture element P5 in the second row. Since the driving voltage VD5 is applied to the picture element P5 in the scanning period T2, only the voltage VGC is pulled up because the scanning signal VG3 is applied to the scanning line. Y3 in the third row in the next scanning period T3. On the contrary, as shown in FIG. 7I, the driving voltage VD13 to be applied to the picture element P13 in the fourth row is applied in the scanning period T4 and, in the next period T5, the voltage VGC is superposed in the next period T5, because the common line driving voltage VCS corresponding to the scanning signal in the fifth row is applied to the return circuit of the condenser CS13. Consequently, the effective value of the driving voltage VD13 applied to the picture element P13 in the fourth row is equal to that of the driving voltage VD13 applied to the picture element P5 in the second row, and as a result, the optical transmissivity of the liquid crystal forming the picture elements P is uniform and the display quality can be prevented from being deteriorated.

Additionally, although the picture elements P5, P13 in the second and fourth rows, respectively, are taken as examples in the above description, the description may be applicable to the other picture elements in the second and fourth rows. Needless to say, the voltage VGC is also superposed on the waveforms of the driving voltages VD1–VD4, VD9–VD12 applied to the picture elements in the first and third rows not shown in the figures (e.g., picture elements P1–P4, P9–P12).

On the basis of FIG. 7, the following values are applied to the equation (1) in order to obtain the effective value voltage $VD_{rms}$:

capacitance Cp of picture element P=capacitance Cs of condenser CS scanning signal level VG=VGH–VGL=25 (V)

ON period $T_{on}$ of switching element SW=50 μS (=0.05 mS)

one horizontal scanning period=63.5 μS one vertical scanning period=262.5H (=16.7 mS)

display signal level VS=±4 V, namely $$\begin{aligned} VGC &= Cs(VGH - VGL)/(Cp + Cs) \\ &= 25/2 \\ &= 12.5(V) \end{aligned}$$

When the voltage VGC is not superposed, the effective value $VD_{rms1}$ of the driving voltage VD is as follows:

$$VD_{rms1}=4\ (V),$$

wherein the cycle is the vertical scanning period 2 V, and equal to the level of the display signal VS.

On the other hand, when the voltage VGC is superposed, the effective value $VD_{rms2}$ of the driving voltage VD is as follows:

$$\begin{aligned} VD_{rms2} &= \sqrt{\frac{(1B - T_{on})VS^2 + T_{on}(VGC + VS)^2 + (1B - T_{on})(-VS)^2 + T_{on}(VGC - VS)^2}{2B}} \\ &= \sqrt{Vs^2 + \frac{T_{on} \cdot V_{GC}^2}{1B}} \\ &= \sqrt{4^2 + \frac{0.05 \times 12.5^2}{16.7}} \\ &= 4.06(V) \end{aligned}$$

wherein the cycle is the vertical scanning period 2B.

Consequently, in display devices of th prior art, for example, the driving voltages VD55, VD63 applied to the picture element P55 in the second row and to the picture element P63 in the fourth row, respectively, are different by 0.06 (V) in effective value of driving voltage and that causes different optical transmissivities, which leads to deterioration in display quality.

On the contrary, as shown in FIG. 1, the return circuits of the condensers CS13–CS16 in the last row, according to the invention, are connected to a common line Ycs and a common line driving voltage VCS as shown in FIGS. 2E, 7E is applied to the common line Ycs in order that the voltages of both terminals of the condensers CS13–CS16 in the last row are equal to that of the condensers CS1–CS12 in the other rows, and consequently the effective values of the driving voltages applied to the picture elements P are equalized and the differences in optical transmissivity are not caused. As a result, the quality of a displayed image can be improved and sufficient information can be displayed because it is not required to mask the scanning lines.

In the aforementioned embodiment, the counter electrode driving voltages VQ are of a constant direct current level, and the common line drive voltage VCS which is at the same level as the scanning signals VG1–VG4 is applied to the common line Ycs. Substitutionally, another embodiment may be employed such that, in order to correct the effective value of the drive voltage VD to be applied to the picture elements P in the last (or first) row, a common line driving voltage VCS whose amplitude of the common line driving voltage VCS is higher than that of the counter electrode driving voltage VQ may be generated to be applied to the common line Ycs. When the voltage level to be applied is enhanced by ΔV to increase the level of the common line driving voltage VCS, the voltage x divided for the drain out of the ΔV is $$x=\Delta V \cdot Cs/(Cs+Cp) \tag{2}$$

Additionally, the effective value $V_{rms3}$ of the voltage x applied to the liquid crystal is $$\begin{aligned} V_{rms3} &= \sqrt{\frac{\left(1B - \frac{B}{2}\right)(+VS)^2 + \left(1B - \frac{B}{2}\right)(x + VS)^2 + \left(1B - \frac{B}{2}\right)(-VS)^2 + \left(1B - \frac{B}{2}\right)(-x - VS)^2}{2B}} \\ &= \frac{\sqrt{2}}{2}(x^2 + 2VS \cdot x + 2VS^2)^{1/2} \end{aligned} \tag{3}$$

wherein B is the vertical scanning period of one field. Hereupon, when $C_s=C_p$, Vs=4 (V), and $V_{vrms3}=V_{rms2}=4.06$ (V), from the equations (2), (3) is derived ΔV as follows:

$$\Delta V=2x=2\times 0.12=0.24\ (V)$$

Accordingly, the common line driving voltage VCS to be applied to the common line Ycs has a higher level by 0.24 (V) than the counter electrode driving voltage VQ. When the counter electrode driving voltage VQ is a square wave with the center ±3 V, namely 6 V, it is sufficient to generate the square wave with an amplitude of 6 V and apply it to the common line Ycs. When the counter electrode driving voltage VQ equals to zero, it is sufficient to apply the square wave with an amplitude of 0.24 V as the common line driving voltage Vcs, whereby the voltage having an effective value of 0.12 V is individually added to the driving voltages VD13–VD16 in the fourth row over the entire scanning period.

FIGS. 8A–8I are waveform diagrams showing performance waveforms of still another embodiment of the invention when the counter electrode voltage VQ is constant and the common line driving voltage VCS is enhanced by ΔV. FIGS. 8A–8I are similar to FIGS. 7A–7I, respectively, and the parts corresponding to each other are represented by the same reference numerals. FIGS. 8A–8D, which are identical to those shown in FIGS. 7A–7D, show scanning signals VG1–VG4. FIG. 8E shows the waveform of the common line driving voltage VCS. In the embodiment, the level of the common line driving voltage VCS is enhanced by ΔV on the basis of the above-mentioned calculation. FIG. 8F shows the waveform of the counter electrode driving voltage VQ, which is maintained to be a certain DC potential at a level of 0 V.

Thereby, for example, the wave form of the driving voltage VD13 applied to the picture element P13 in the last row, as shown in FIG. 8I, is such that the voltage ΔV/2 is added every two horizontal scanning period, though the voltage VGC is not superposed. Accordingly, the effective voltage of the driving voltage VD13 over the entire scanning period becomes equal to the driving voltage VD5 in FIG. 8H.

Figure 8:
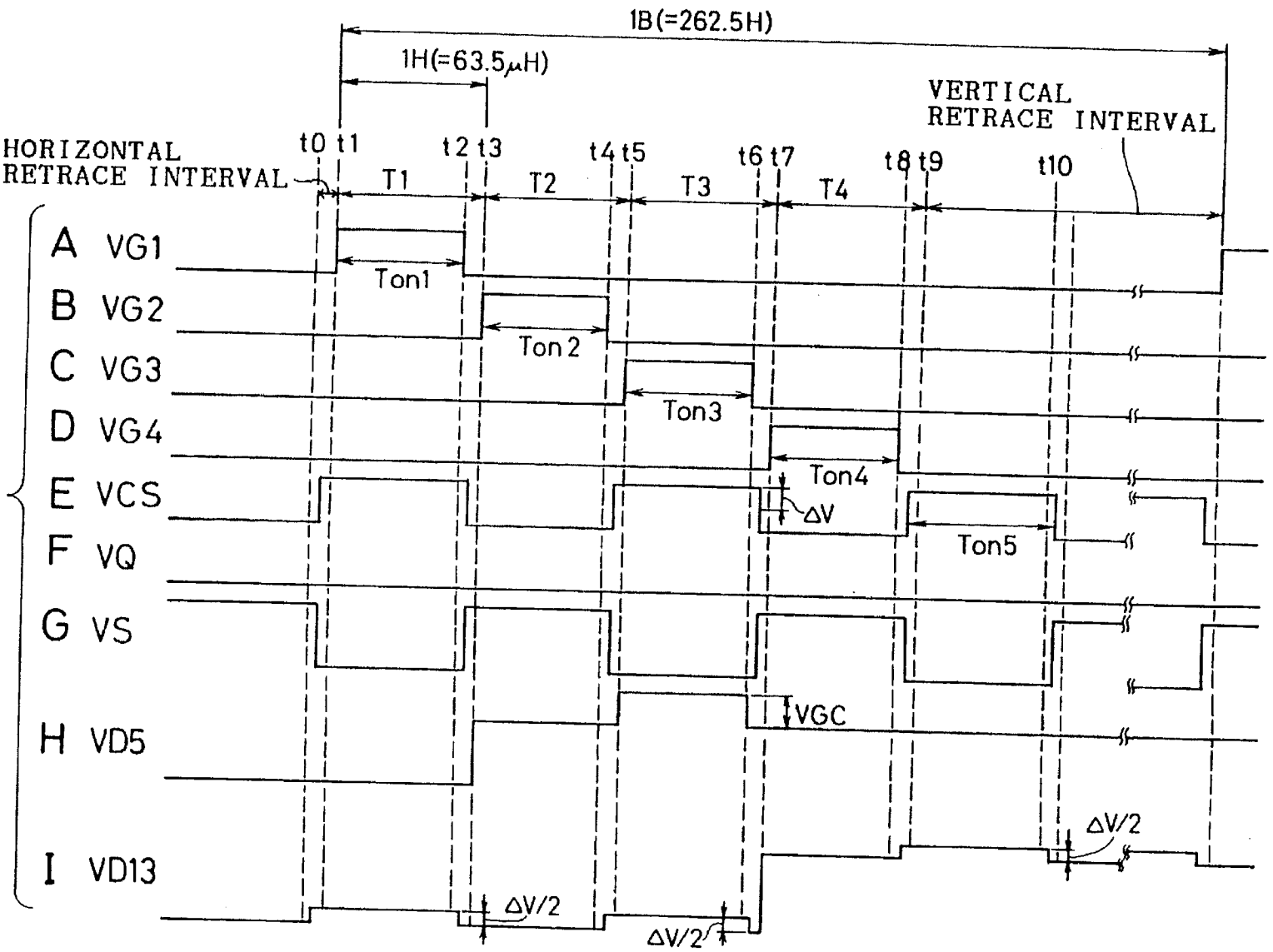
FIGS. 8A–8I are waveform diagrams showing a performance waveform of each part of the still another embodiment of the invention.
Figure 9:
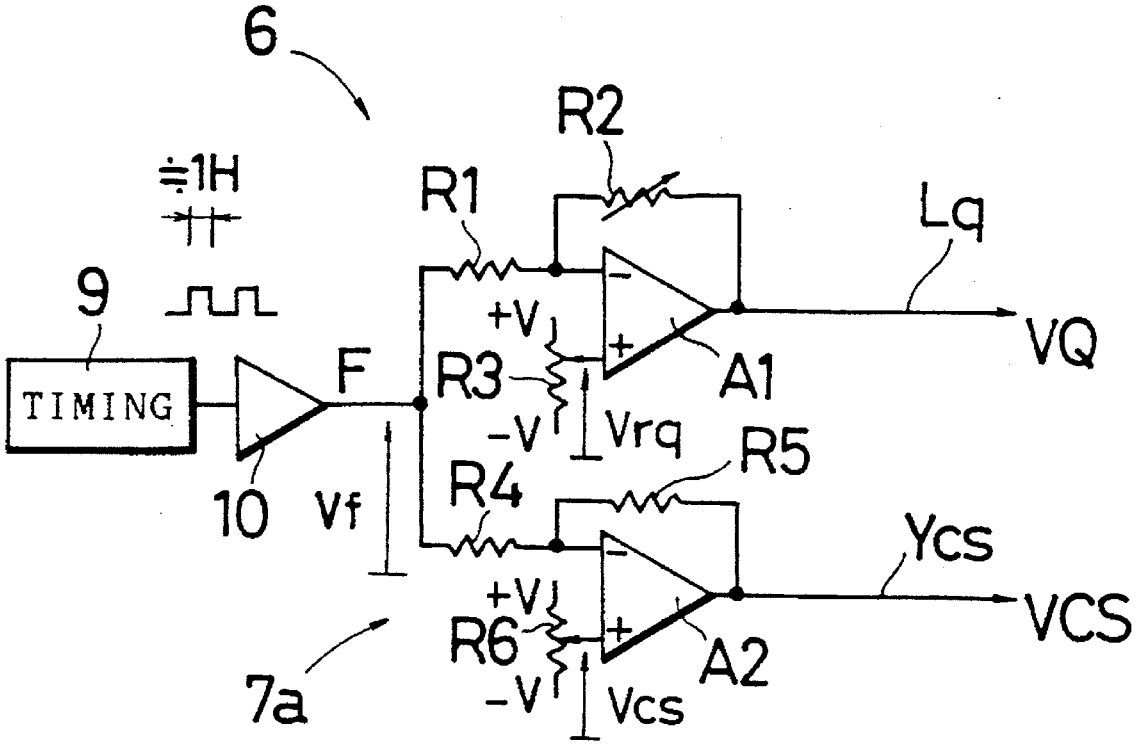
FIG. 9 is a block diagram showing a constitution of a counter electrode driving circuit and a common line driving circuit used in the embodiment of FIG. 8.
Figure 10:
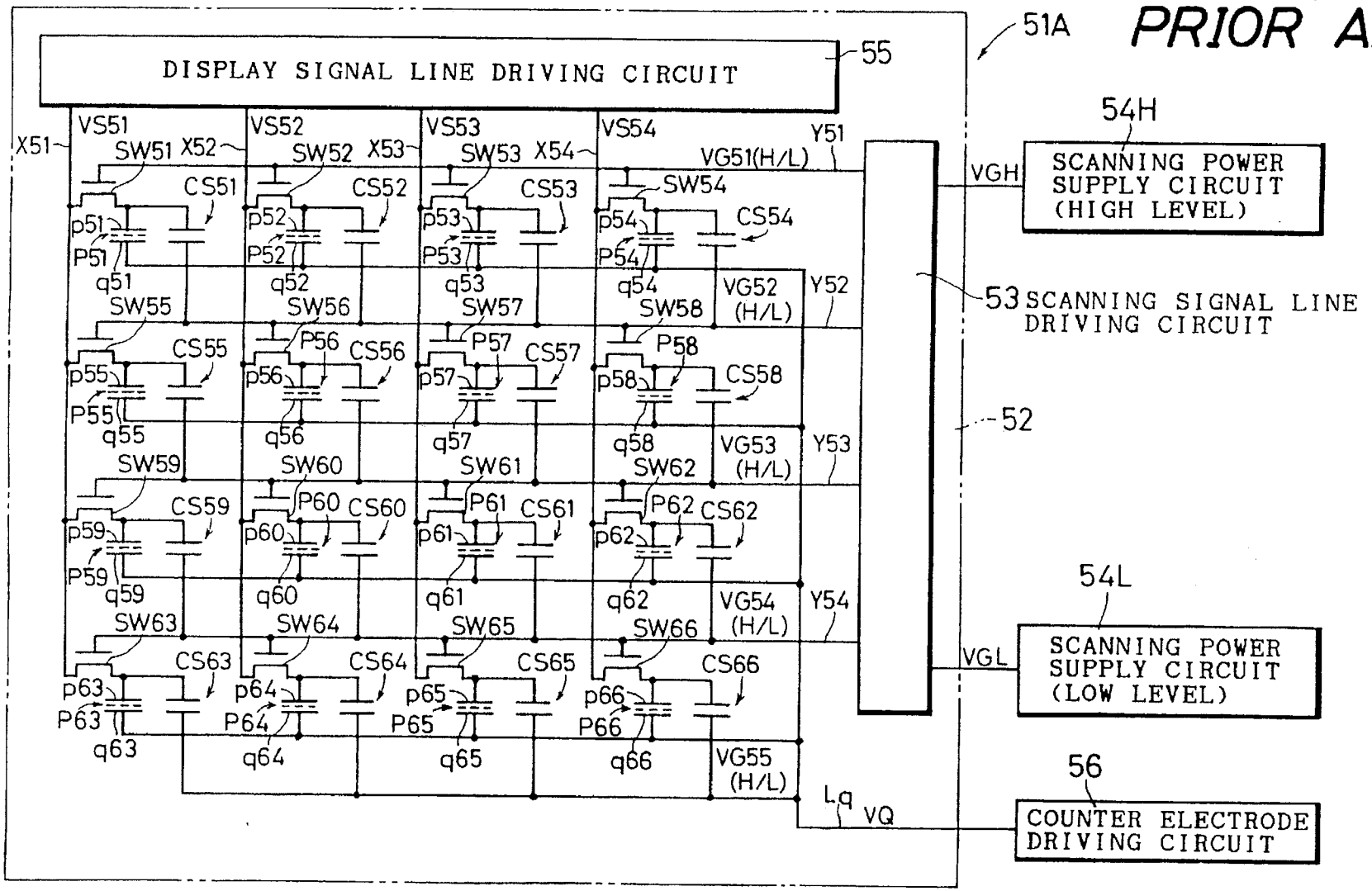
FIG. 10 PRIOR ART
FIG. 10 is a block diagram showing a constitution of a conventional display device.
Figure 11:
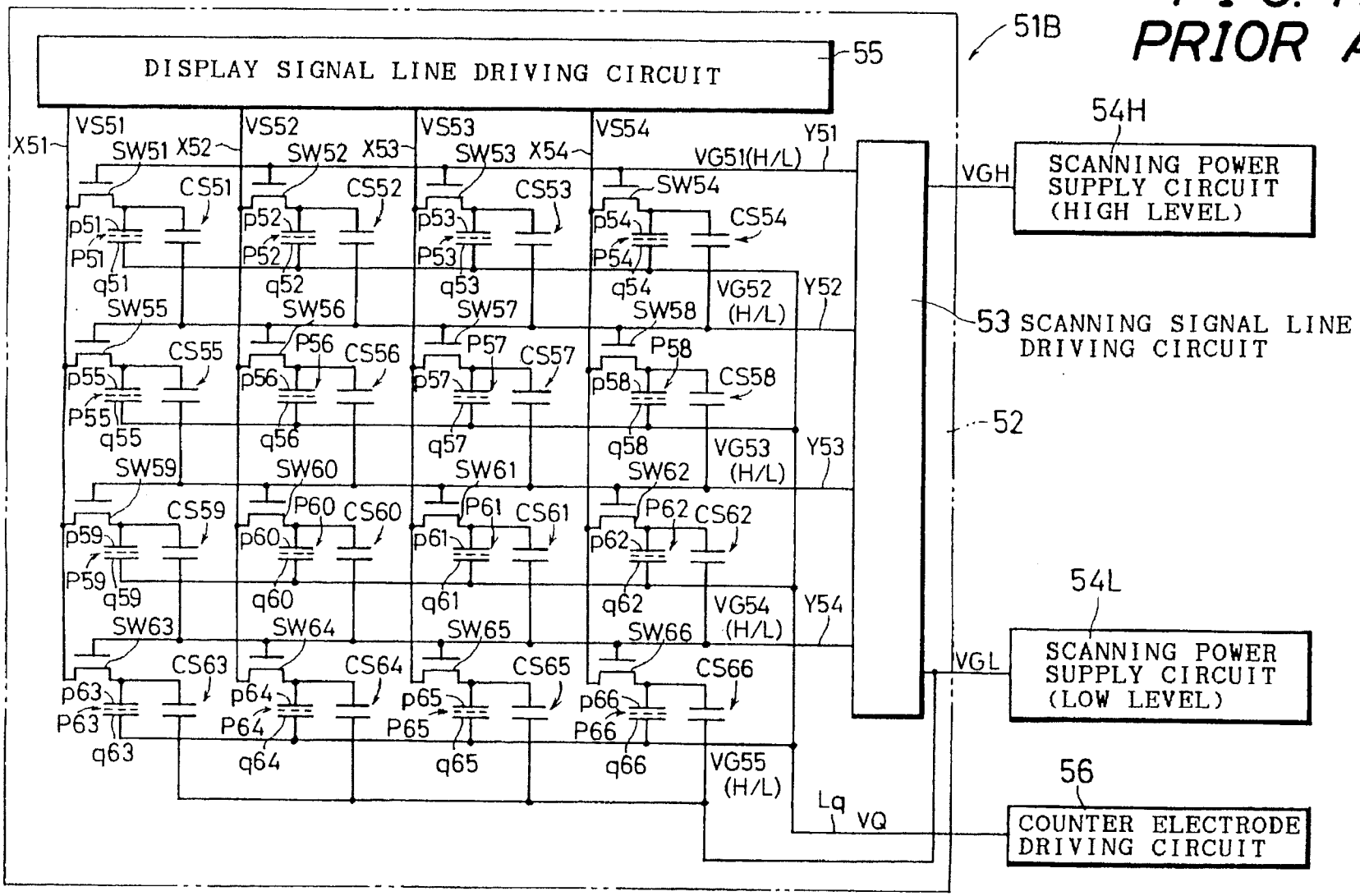
FIG. 11 PRIOR ART
FIG. 11 is a block diagram showing other constitution of a conventional display device.
Figure 12:
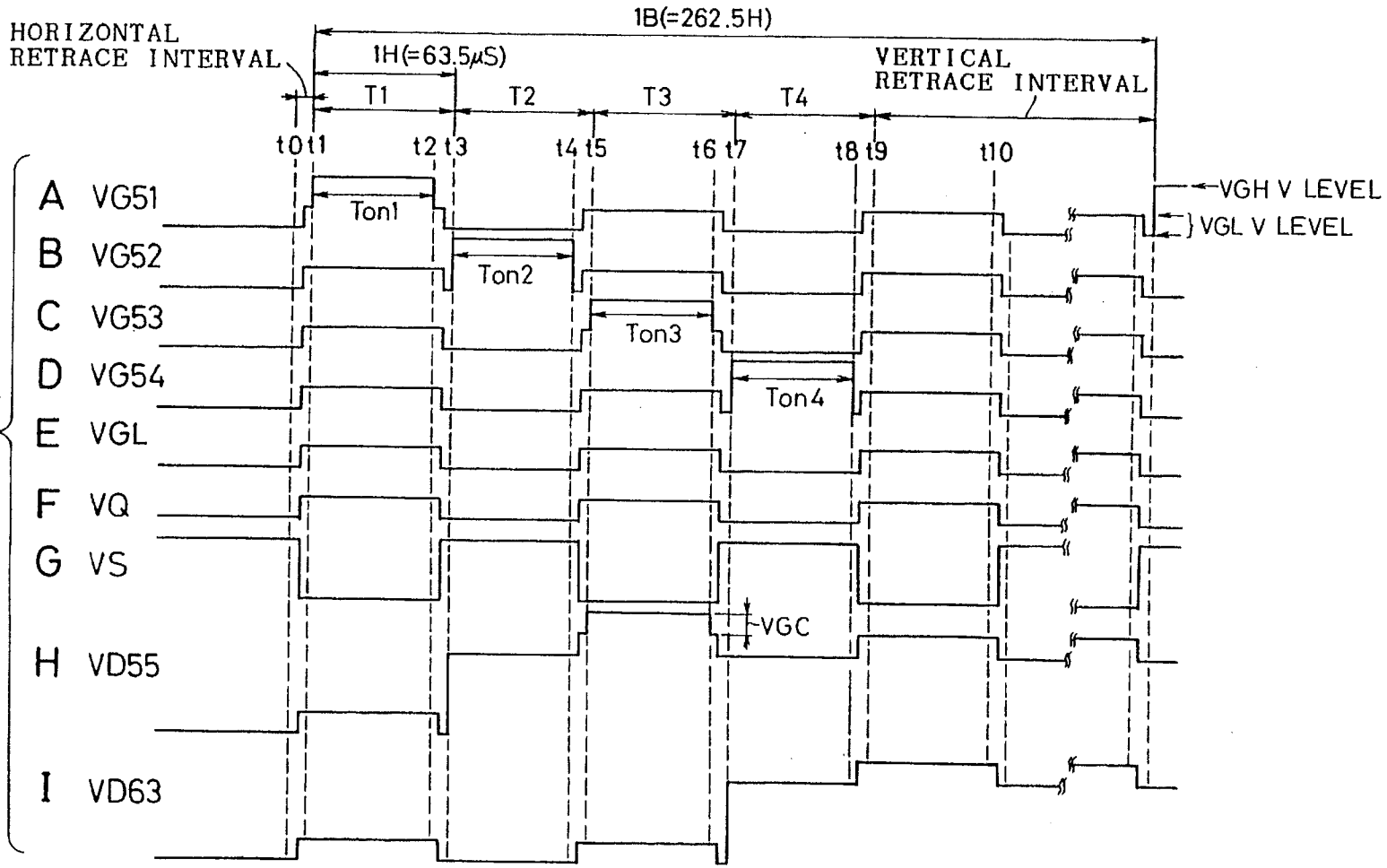
FIG. 12 PRIOR ART
FIGS. 12A–12I are waveform diagrams showing a performance waveform of each part of the display device shown in FIG. 10.

FIG. 9 is a block diagram showing a construction of a counter electrode driving circuit 6 and a common line driving circuit 7*a* for generating the counter electrode driving voltage VQ and the common line driving voltage VCS as shown in FIG. 8. Both of the two driving circuits have the same circuit configuration. The counter electrode driving circuit 6 comprises an operational amplifier A1, a resistance R1, and variable resistances R2, R3, wherein a standard voltage Vrq preset by the variable resistance R3 is supplied to the not-inverted input terminal of the operational amplifier A1 and a timing signal F is inputted into the inverted terminal of the operational amplifier A1 through the resistance R1. The timing signal F is a signal which synchronizes with the horizontal scanning period 1H and is outputted from the timing circuit 9 through a buffer circuit 10. The level Vf of the timing signal is preset, for example, to be 5 V. The timing circuit 9 as shown in FIG. 3 may be used as the timing circuit 9 or it is also allowed to generate timing signals in the other circuits.

Since the gain of the operational amplifier A1 is defined with the ratio R2/R1 of the variable resistance R2 to the resistance R1, the counter electrode driving voltage VQ is as follows:

$$VQ=Vrq-(Vf-Vrq)R2/R1 \quad (4)$$

Accordingly, the resistance value of the variable resistance R2 is zero, the counter electrode driving voltage VQ equals to the standard voltage Vrq preset by the variable resistance R3. When Vrq=3 (V), the level of the counter electrode driving voltage VQ is also set to be 3 (V) and is derived to the counter electrode driving line Lq.

A common line driving circuit 7*a* comprises an operational amplifier A2, a resistance R4, and variable resistances R5, R6, wherein a standard voltage Vcs set by the variable resistance R6 is supplied to the not-inverted input terminal of the operational amplifier A2 and a timing signal F is inputted into the inverted terminal of the operational amplifier A1 through the resistance R4. The common line driving voltage VCS derived from the operational amplifier A2 to the common line Ycs is as follows:

$$VCS=Vcs-(Vf-Vcs)R5/R4=(1-(R5/R4))Vcs-(R5/R4)Vf \quad (5)$$

Accordingly, in the case of a square wave of Vf=5, when the resistances R4, R5 are set so that R5/R4=0.048, a square wave having a voltage of 0.24 (V) can be obtained. Driving voltages VQ, VCS of any level corresponding to the conditions for use of display panel can be obtained by the counter electrode driving circuit 6 and common line driving circuit 7 as shown in FIG. 9.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A display device comprising:

a. a display panel including:

a plurality of picture element electrodes arranged in a matrix form, a counter electrode formed to confront the picture element electrodes, a plurality of switching elements individually connected to the plurality of picture element electrodes, a plurality of scanning signal lines to which scanning signals for connecting/disconnecting the switching elements individually are applied, a plurality of display signal lines which are arranged to intersect the scanning signal lines and apply display signals via the switching elements to the plurality of picture element electrodes, a counter electrode driving line connected to the counter electrode, and a plurality of capacitance elements each having one terminal individually connected to a respective one of the plurality of picture element electrodes and other terminals which are connected to the scanning signal lines selected prior to or after one horizontal scanning period;

b. a scanning signal lines driving circuit which sequentially scans the scanning signal lines every horizontal scanning period and applies the scanning signals;

c. a display signal lines driving circuit which applies display signals to the display signal lines; and d. a counter electrode driving circuit which applies a counter electrode driving voltage to the counter electrode driving line, wherein a common line to which the other terminal of the capacitance elements connected to picture element electrodes provided in connection with only the scanning signal lines selected by a first or last scanning of the sequential line scannings are connected, is provided in the display panel, the display device further comprises a common line driving circuit which applies to the common line a driving voltage for changing the voltage levels of the other terminals of the respective capacitance elements connected to the picture element electrode provided in connection with the scanning signal lines selected only by the first or last scanning of the sequential line scanning, and wherein the driving voltage which is supplied to the common line from the common line driving circuit is the scanning signal or a signal generated by phase-shifting the scanning signal.

2. The device of claim 1, wherein the common line driving circuit applies the driving voltage to the common line in a vertical retrace interval.

3. A display device comprising:

a. a display panel including:

a plurality of picture element electrodes arranged in a matrix form, a counter electrode formed to confront the picture element electrodes, a plurality of switching elements individually connected to the plurality of picture element electrodes, a plurality of scanning signal lines to which scanning signals for connecting/disconnecting the switching elements individually are applied, a plurality of display signal lines which are arranged to intersect the scanning signal lines and apply display signals via the switching elements to the plurality of picture element electrodes, a counter electrode driving line connected to the counter electrode, and a plurality of capacitance elements each having one terminal individually connected to a respective one of the plurality of picture element electrodes and other terminals which are connected to the scanning signal lines selected in a following horizontal scanning period;

b. a scanning signal lines driving circuit which sequentially scans the scanning signal lines every horizontal scanning period and applies the scanning signals;

c. a display signal lines driving circuit which applies display signals to the display signal lines; and d. a counter electrode driving circuit which applies a counter electrode driving voltage to the counter electrode driving line, wherein a common line to which the other terminals of the capacitance elements connected to picture element electrodes provided in connection with only the scanning signal lines selected by a last scanning of the sequential line scannings are connected, is provided in the display panel, and wherein scanning signals in a first scanning signal line are applied as driving voltages for changing the voltage levels of the other terminals of the respective capacitance elements connected to the picture element electrodes provided in connection with the scanning signal lines selected only by the last scanning of the sequential line scannings.

4. A display device comprising:

a. a display panel including:

a plurality of picture element electrodes arranged in a matrix form, a counter electrode formed to confront the picture element electrodes, a plurality of switching elements individually connected to the plurality of picture element electrodes, a plurality of scanning signal lines to which scanning signals for connecting/disconnecting the switching elements individually are applied, a plurality of display signal lines which are arranged to intersect the scanning signal lines and apply display signals via the switching elements to the plurality of picture element electrodes, a counter electrode driving line connected to the counter electrode, and a plurality of capacitance elements each having one terminal individually connected to the plurality of picture element electrodes and other terminals which are connected to the scanning signal lines selected in a following horizontal scanning period;

b. a scanning signal lines driving circuit which sequentially scans the scanning signal lines every horizontal scanning period and applies the scanning signals;

c. a display signal lines driving circuit which applies display signals to the display signal lines; and d. a counter electrode driving circuit which applies a counter electrode driving voltage to the counter electrode driving line, wherein a common line to which the other terminal of the capacitance elements connected to picture element electrodes provided in connection with only the scanning signal lines selected by the last scanning of the sequential line scannings are connected, is provided in the display panel, and scanning signals in a scanning signal line of one or more lines before the last scanning line are applied as driving voltages for changing the voltage levels of the other terminals of the respective capacitance elements connected to the picture element electrodes provided in connection with the scanning signal lines selected only by the last scanning of the sequential line scannings.

5. A display device as in claim 1 wherein driving voltages applied to the picture elements of the first or last sequential line scannings are identical to the driving voltages for line scannings other than the first or last line scannings so as to obtain uniform transmissivity in all pixel elements forming the display panel.

* * * * *